US011925242B2

(12) United States Patent
Chan

(10) Patent No.: US 11,925,242 B2
(45) Date of Patent: Mar. 12, 2024

(54) BUCKLE WITH PULL RING

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 18/205,585

(22) Filed: Jun. 5, 2023

(65) Prior Publication Data

US 2023/0309662 A1 Oct. 5, 2023

Related U.S. Application Data

(62) Division of application No. 17/712,307, filed on Apr. 4, 2022, now Pat. No. 11,723,440.

(51) Int. Cl.
*A44B 11/25* (2006.01)

(52) U.S. Cl.
CPC ..... *A44B 11/2588* (2013.01); *A44B 11/2584* (2013.01)

(58) Field of Classification Search
CPC . A44B 11/2588; A44B 11/2584; A45C 13/26; A45C 13/262; Y10T 16/451
USPC ..... 16/444
See application file for complete search history.

(56) References Cited

U.S. PATENT DOCUMENTS 5,131,650 A * 7/1992 Hall ..... A63B 21/0552 482/904
5,546,642 A 8/1996 Anscher
5,885,196 A * 3/1999 Gvoich ..... A63B 21/00185 482/125
5,911,369 A * 6/1999 Yamazaki ..... A44B 19/262 24/429

(Continued)

FOREIGN PATENT DOCUMENTS

CN 104968398 A 10/2015
CN 205848884 U 1/2017

(Continued)

OTHER PUBLICATIONS

Notification of Transmittal of the International Search Report and the Written Opinion of the International Searching Authority with attached International Search Report and Written Opinion of the International Searching Authority in PCT/CN2023/084090, dated Jun. 29, 2023.

*Primary Examiner* — Robert Sandy
(74) *Attorney, Agent, or Firm* — Collard & Roe, P.C.

(57) ABSTRACT

A pull ring for a buckle assembly that has a main body with a first hook element facing a rear end, and an actuation button. The actuation button is connected to the main body by a spring so that the actuation button can move between an extended resting position and a compressed position. The actuation button has a second hook element on a bottom surface and which faces the front end of the main body. The pull ring is connected to the main body and actuation button by fitting the pull ring around the first hook element, (Continued)

pressing the actuation button, pivoting the actuation button and main body until the second hook element is disposed within a central aperture of the pull ring, and releasing the actuation button so that the pull ring is retained in the hook elements under pressure by the spring.

4 Claims, 9 Drawing Sheets

(56) References Cited

U.S. PATENT DOCUMENTS

| | | | | |
|---|---|---|---|---|
| 6,151,758 | A * | 11/2000 | Chiu | A63B 21/4043 16/442 |
| 6,446,314 | B1 | 9/2002 | Anscher | |
| 6,599,015 | B1 * | 7/2003 | Bogatez | F16G 11/103 24/265 A |
| 8,656,566 | B1 | 2/2014 | Chen | |
| 9,247,788 | B2 | 2/2016 | Brace et al. | |
| 9,677,581 | B2 | 6/2017 | Tucholke et al. | |
| 10,702,025 | B1 | 7/2020 | Paik et al. | |
| 10,960,241 | B2 | 3/2021 | Emonin | |

FOREIGN PATENT DOCUMENTS

| | | | |
|---|---|---|---|
| CN | 107105803 | A | 8/2017 |
| CN | 206933539 | U | 1/2018 |
| CN | 210203582 | U | 3/2020 |
| JP | 2014-188172 | A | 10/2014 |
| WO | 2016/106054 | A1 | 6/2016 |

* cited by examiner

BUCKLE WITH PULL RING

CROSS-REFERENCE TO RELATED APPLICATIONS

This application is a divisional of U.S. patent application Ser. No. 17/712,307, filed on Apr. 4, 2022, the disclosure of which is herein incorporated by reference.

BACKGROUND OF THE INVENTION

1. Field of the Invention

This invention relates to a buckle having a pull ring on which a looped cord is attached. In particular, the invention relates to a buckle that can be attached to a strap and which has a spring-loaded portion that allows for engagement and disengagement of the pull ring.

2. The Prior Art

Two-piece buckles are often used to attach two straps or cords to each other, or to attach a strap to an article such as a piece of luggage. These buckles often take the form of a side-release buckle such as shown in U.S. Pat. No. 5,546,642 to Anscher or a center-push type buckle such as shown in U.S. Pat. No. 6,446,314 to Anscher. However, it is often desirable to construct a buckle in which the components are even more lightweight and simple to manufacture. Furthermore, attachment of a cord to traditional buckles is often not simple, as these buckles are made to accommodate flat straps.

SUMMARY OF THE INVENTION

It is an object of the invention to develop a two-piece buckle in which at least one of the components is simple and lightweight. It is another object of the invention to provide a buckle in which a cord can be securely attached.

This object is accomplished by a buckle assembly comprising two separate buckle portions that are connected together under spring tension. The first buckle portion comprises a main body with a top surface, a bottom surface, a front end and a rear end. The bottom surface of the first buckle portion has a first hook element with an engaging surface that faces the rear end. An actuation button is disposed in a cavity of the main body and extends to the front end of the main body. The actuation button is connected to the main body by a spring so that the actuation button can slide between an extended resting position and a compressed position by pressing the actuation button toward the rear end of the main body to compress the spring. Releasing the actuation button causes the actuation button to slide back to the extended position by allowing the spring to return to its resting state. The actuation button has a second hook element on its bottom surface. The second hook element has an engaging surface that faces the front end of the main body, so that the first hook element and second hook element face in opposite directions. A strap can be connected to the first buckle portion in any suitable manner. For example, the first buckle portion can be equipped with one or more strap retaining bars that allow the strap to be sewn on or threaded through in an adjustable manner.

The second buckle portion is a generally ring-shaped structure with a central aperture. The second buckle portion is configured for connection to the main body and actuation button by fitting the ring around the first hook element, pressing the actuation button toward the rear end of the main body, pivoting the actuation button and main body until the second hook element is disposed within the central aperture, and releasing the actuation button so that the ring is retained in the hook elements under pressure by the spring. The ring can be used to connect a strap or cord so that an article such as a bag, whistle or other item can be attached to the buckle assembly.

In one embodiment, the second buckle portion is in the form of a pull ring having a ring body with a central aperture, a first face side and a second face side, a first bore extending radially from a radially outer surface of the ring body to the central aperture, a second bore extending radially from the radially outer face of the ring body to the central aperture on an opposite side of the ring body from the first bore, a third bore extending from the first face side of the ring body to the second face side of the ring body adjacent the first bore, and a fourth bore extending from the first face side of the ring body to the second face side of the ring body adjacent the second bore. This arrangement of the bores allows for attachment of a cord in a novel way. The cord is attached by feeding the cord through the first bore from the outside to the central aperture, around to the first face side, through the third aperture to the second face side, into the fourth aperture from the second face side to the first face side, around the ring body and through the second bore from the central aperture to the exterior of the ring body. The ends of the cord are connected to nodes that have a larger diameter than the diameter of the first and second bores so that pulling the pull cord between the third bore and the fourth bore presses the nodes against the first bore and second bore without allowing the pull cord to pass through. This creates a loop extending from the ring, so that objects can be attached to the cord and thus to the buckle assembly by clipping them or looping them onto the cord. The nodes can be molded onto the cord after the cord is assembled on the ring, so that a permanent attachment of the cord to the ring is accomplished.

Preferably, the first bore and the second bore each have an enlarged region at the radially outer surface of the ring body, so that the nodes are seated in the enlarged regions when the pull cord is pulled between the third and fourth bores. In this embodiment, the enlarged region tapers toward the central aperture, and each node has a shape corresponding to the enlarged region, so that the nodes do not extend beyond the radially outer surface of the ring body when the cord is pulled between the third and fourth bores. This way, the nodes do not protrude from the ring body and interfere with its operation. In another embodiment, the radially outer surface of the ring body is flat in an area of the first bore and in an area of the second bore.

The first buckle portion has a main body that is configured to receive the push button in a sliding manner. In one embodiment, the main body comprises two legs that extend toward the front end. The legs each have guide elements in the form of inwardly extending protrusions which slide within guide grooves that are disposed on opposite sides of the actuation button to align the actuation button with the main body.

The actuation button is held in position by force of a spring, which is mounted between the actuation button and the main body. In one embodiment, the spring is a coil spring that is mounted on a post of the main body and which extends into a spring opening in a rear end of the actuation button. The spring is sized and positioned such that in a resting state, the actuation button is kept in an extended position where the second hook element is spaced away from the first hook element by a distance that is larger than the size of the aperture in the second buckle portion.

Preferably, the actuation button sits flush with the top surface of the main body so that the first buckle portion has an ergonomic and aesthetic appearance. To assist in sliding the actuation button during assembly and disassembly of the buckle assembly, the actuation button comprises a downwardly extending push surface on a front end thereof. This give the user a large area, and the pressing direction is directly perpendicular to the push surface, so that sliding of the actuation button is simple and does not require precise positioning of the user's fingers.

In an alternative embodiment, the second buckle portion is releasably attached to a wall plate which can be secured to an article such as by sewing or gluing. This way the second buckle portion is positioned stationary on the flat article which can be a backpack, piece of clothing or any other flat surface, and the first buckle portion can be attached and detached from the second buckle portion to attach additional articles to the flat article.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
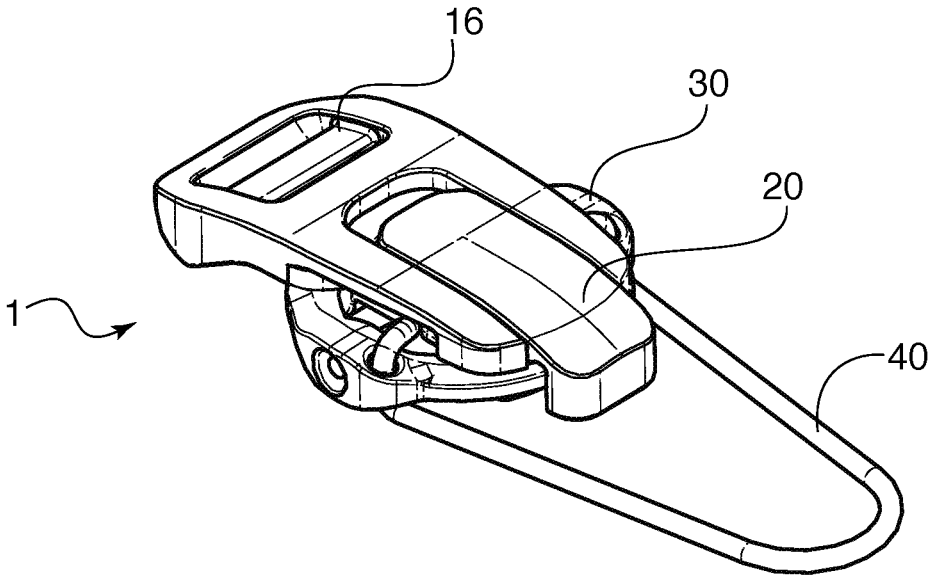
FIG. 1 shows a top perspective view of the buckle assembly according to the invention as assembled.
Figure 2:
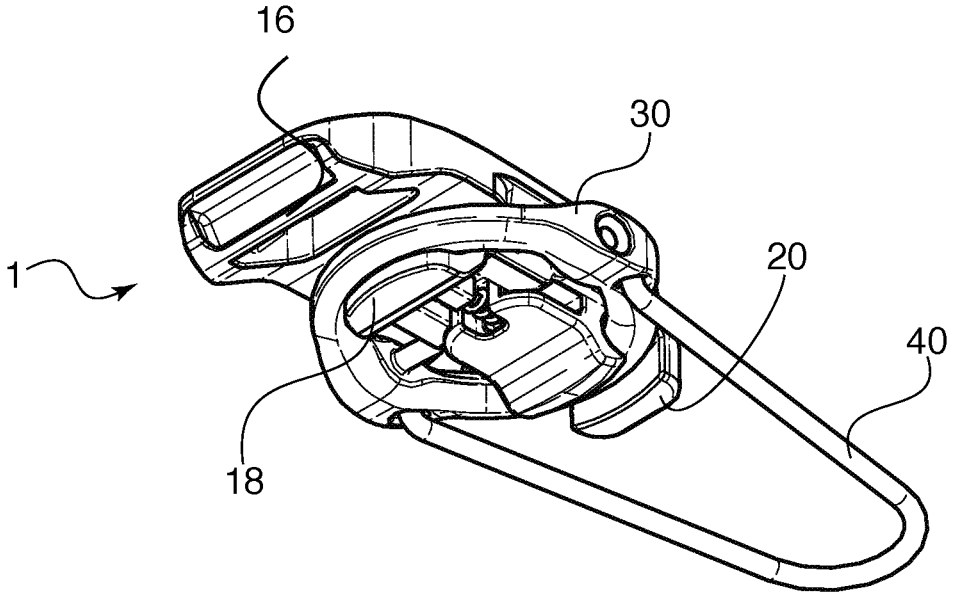
FIG. 2 shows a bottom view of the buckle assembly.
Figure 3:
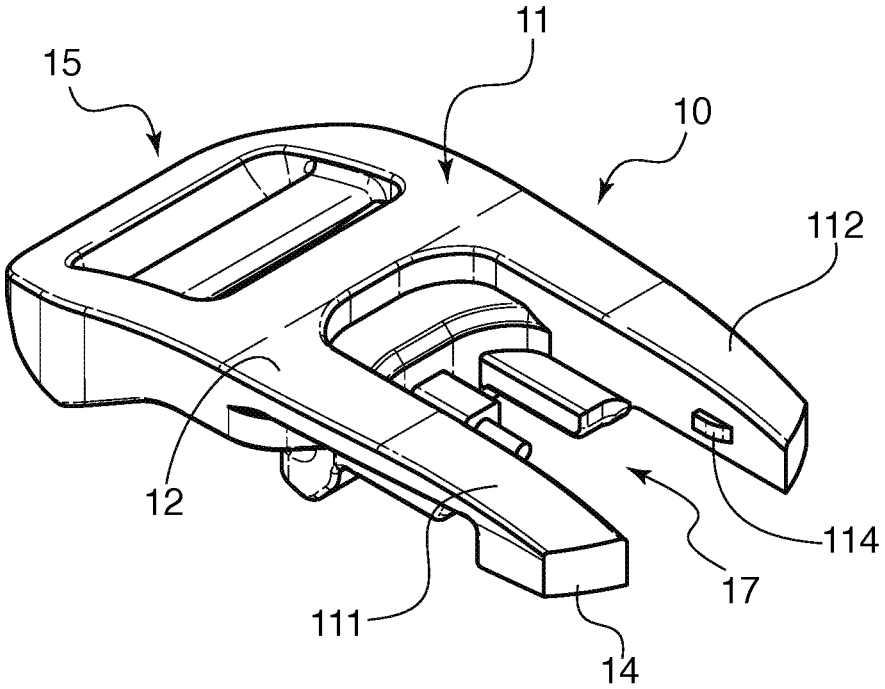
FIG. 3 shows a top perspective view of the main body of the first buckle portion.
Figure 4:
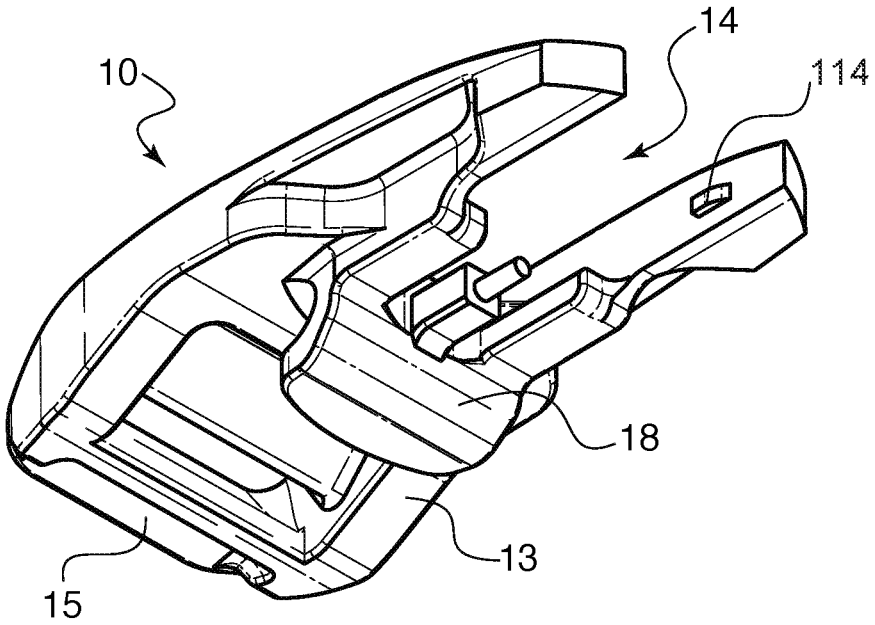
FIG. 4 shows a bottom view of the main body of the first buckle portion.

Referring now in detail to the drawings FIGS. 1 and 2 show the complete buckle assembly according to the invention. Buckle assembly 1 is formed from a first buckle portion 10, an actuation button 20, a second buckle portion in the form of a pull ring 30, and a pull cord 40 connected to pull ring 30. Pull ring 30 is engageable and disengageable from first buckle portion 10 by sliding actuation button 20 under spring force, which will be discussed in detail below.

FIGS. 3-6 show first buckle portion 10, which has a base body 11 with a top surface 12, a bottom surface 13, a front end 14 and a rear end 15. Extending toward front end 14 are two legs 111, 112 between which a cavity 17 for receiving actuation button 20 is disposed. Two guide protrusions 113, 114 extend inwardly from legs 111, 112, respectively. A strap engaging bar 16 is mounted at rear end 15 of base body 11 for connecting a strap to first buckle portion 10. Extending from bottom surface 13 is a first hook element 18, which faces rear end 15 with its engaging surface 118. A spring-engaging post 119 extends from a base structure 19 in cavity 17.

Figure 7:
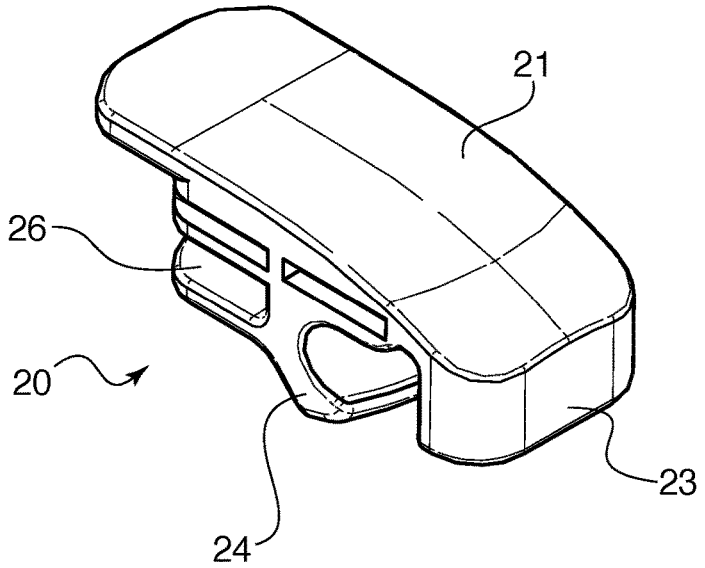
FIG. 7 shows a top perspective view of the actuation button of the first buckle portion.
Figure 8:
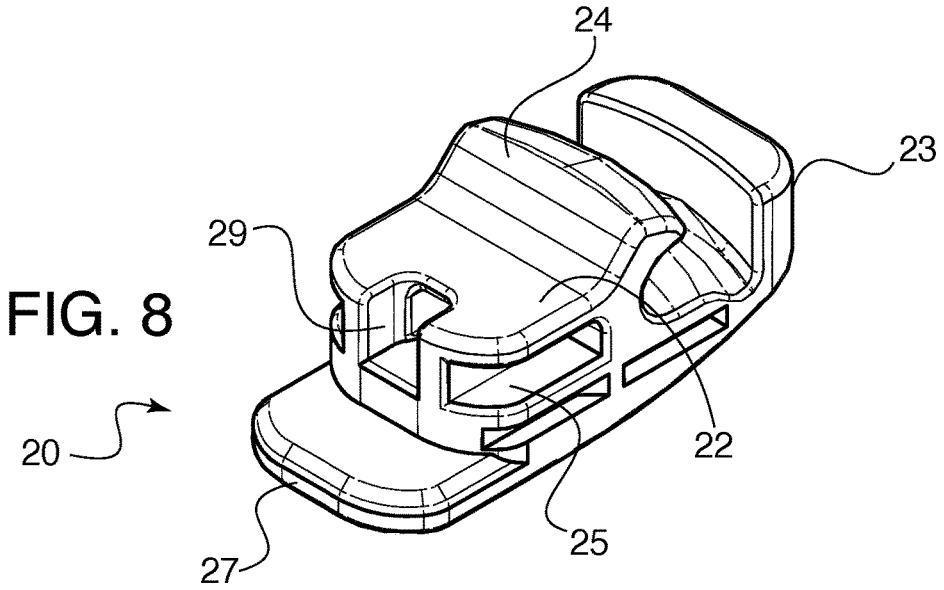
FIG. 8 shows a bottom view of the actuation button.
Figure 9:
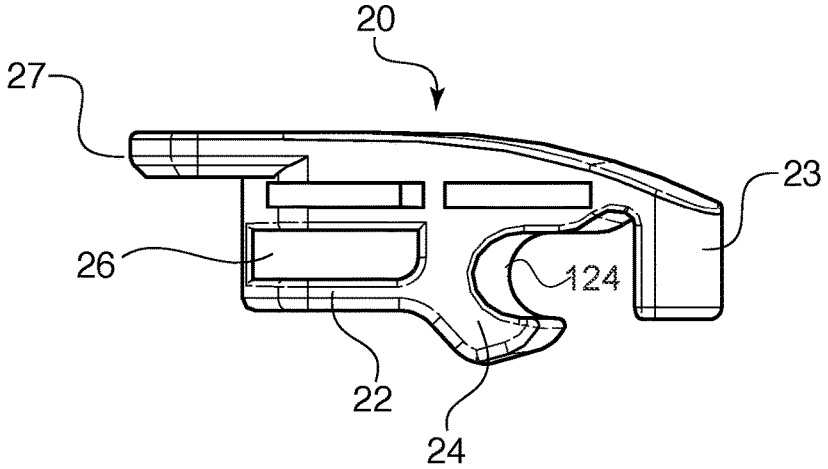
FIG. 9 shows a side view of the actuation button.
Figure 10:
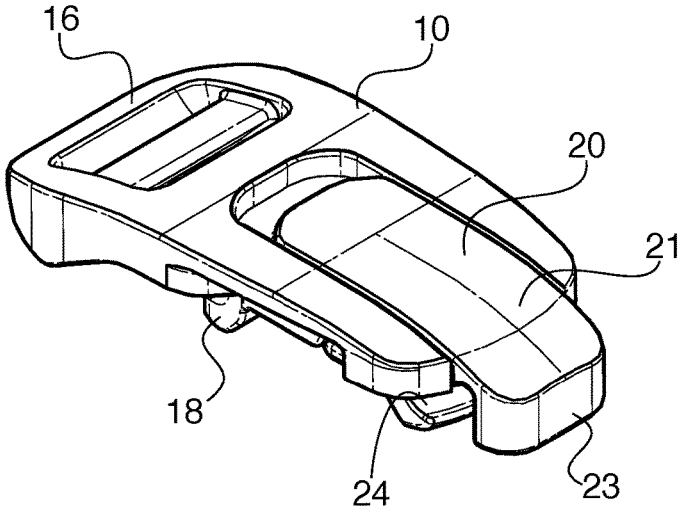
FIG. 10 shows a top perspective view of the first buckle portion as assembled.
Figure 11:
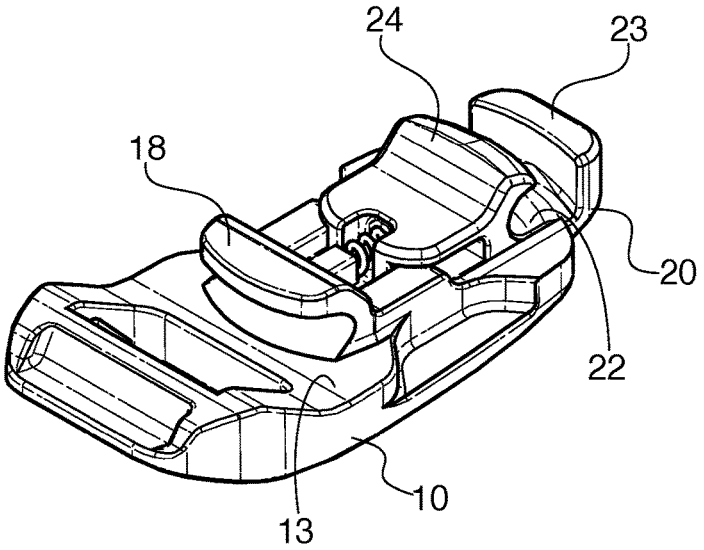
FIG. 11 shows a bottom perspective view of the first buckle portion as assembled.
Figure 12:
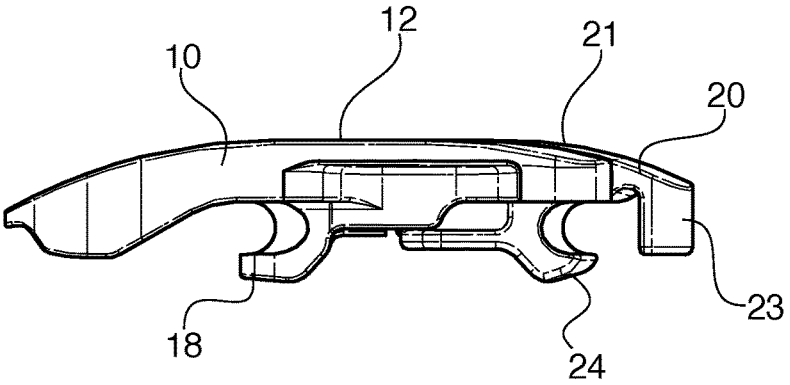
FIG. 12 shows a side view of the first buckle portion as assembled.

FIGS. 7-9 depict actuation button 20, which has a top surface 21, a bottom surface 22, and a downwardly extending push surface 23. Extending from bottom surface 22 is a second hook element 24, which has an engaging surface 124 that faces push surface 23 and extends in an opposite direction from first hook element 18 when actuation button 20 is assembled on first buckle portion 10. Guide grooves 25, 26 are disposed in sides of actuation button 20 facing a rear end 27 of actuation button 20.

Figure 5:
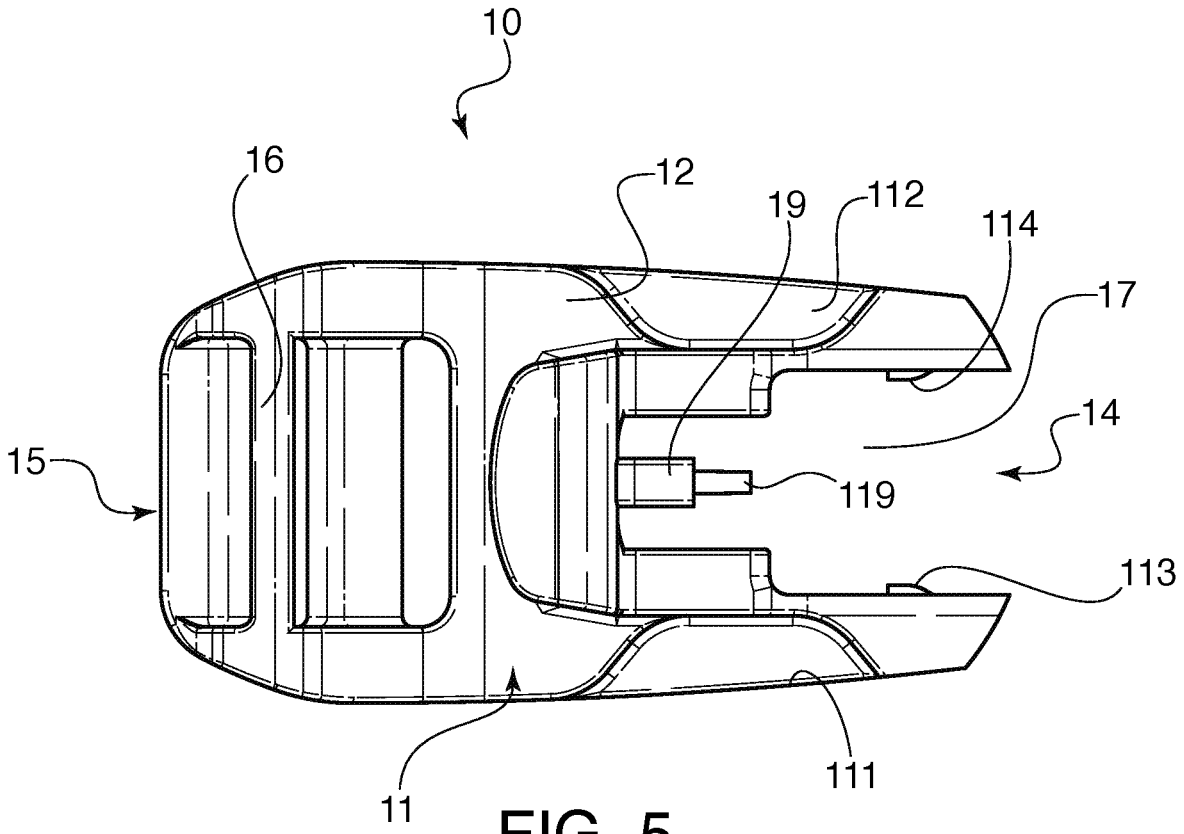
FIG. 5 shows a top plan view of the main body of the first buckle portion.
Figure 6:
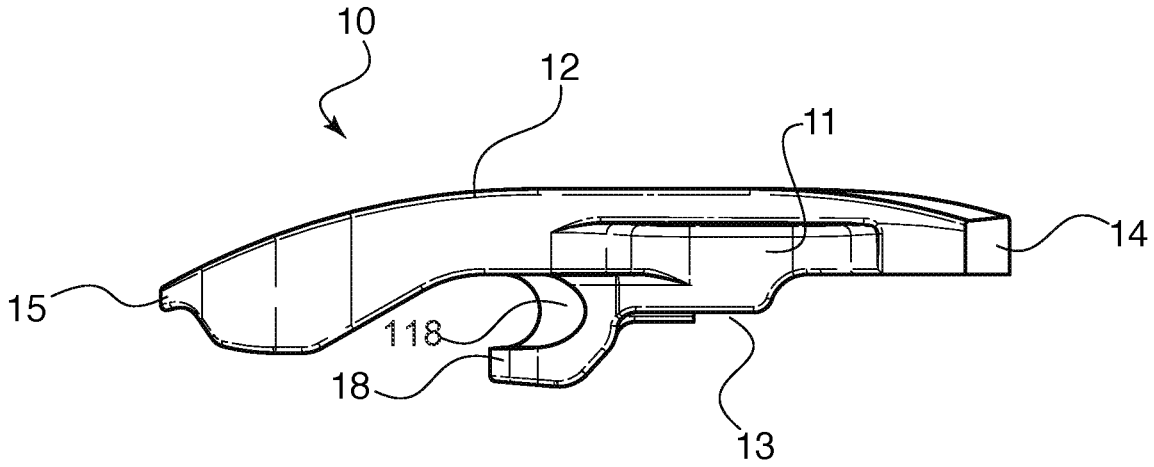
FIG. 6 shows a side view of the main body of the first buckle portion.
Figure 13:
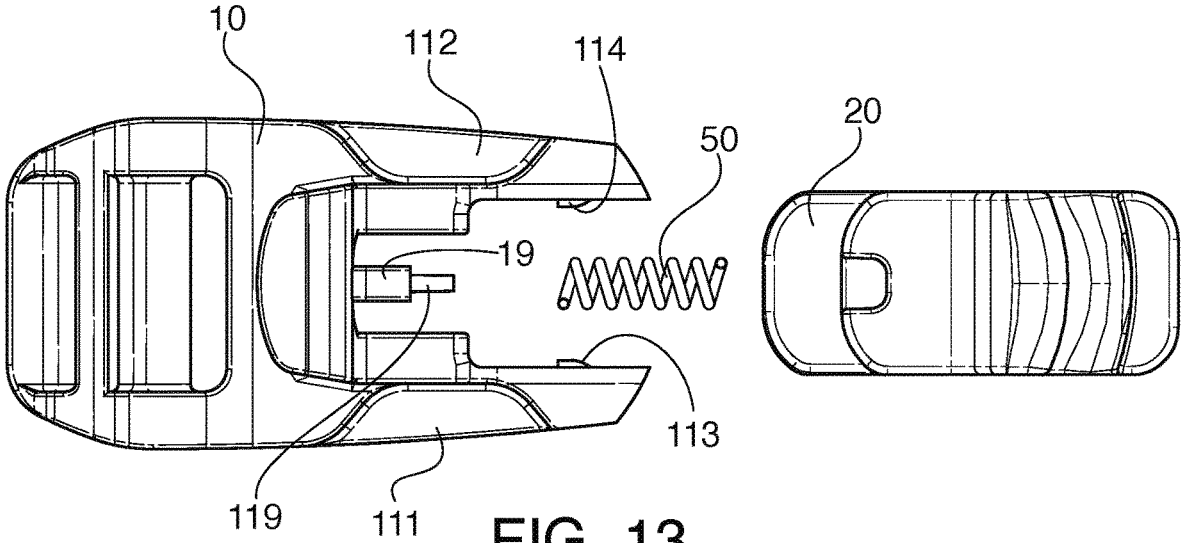
FIG. 13 shows an exploded view of the components of the first buckle portion.
Figure 14:
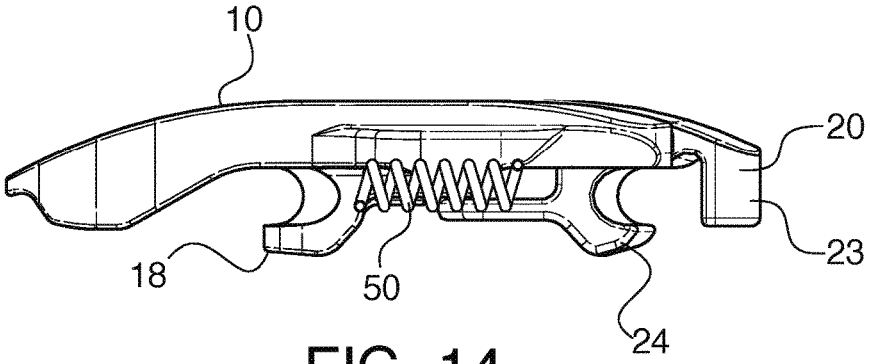
FIG. 14 shows a cut-away side view of the first buckle portion as assembled in a resting state.
Figure 15:
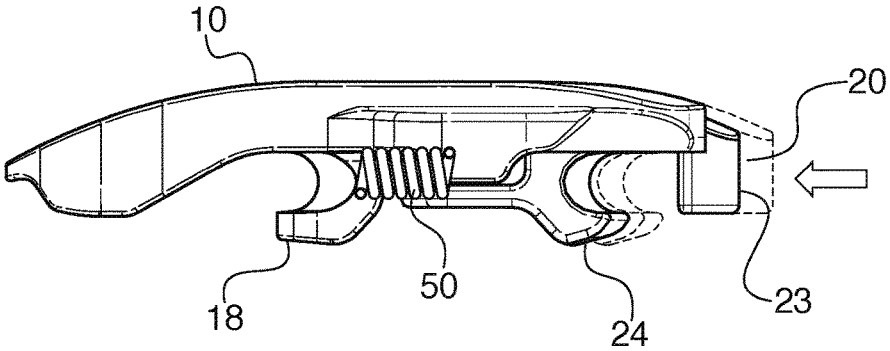
FIG. 15 shows a cut-away side view of the first buckle portion as assembled in a compressed state.

Actuation button 20 is assembled on to first buckle portion 10 as shown in FIGS. 10-15. Here, guide protrusions 113, 114 from legs 111, 112 (as seen in FIG. 5) are slid into guide grooves 25, 26 of actuation button 20 (as seen in FIGS. 7-9) to seat actuation button 20 in cavity 17 of first buckle portion 10. A spring 50, shown in FIGS. 13-15, is connected to first buckle portion 10 by mounting one end on spring engaging post 119 of first buckle portion 10, and the other end in a spring opening 29 of actuation button 20. In a resting state as shown in FIGS. 10-12 and 14, actuation button 20 is held in an extended position by spring 50. Pressing push surface 23 toward first buckle portion 10 causes actuation button 20 to slide farther into cavity 17 of first buckle portion 10 to compress the buckle assembly, which is shown in FIG. 15.

Figure 16:
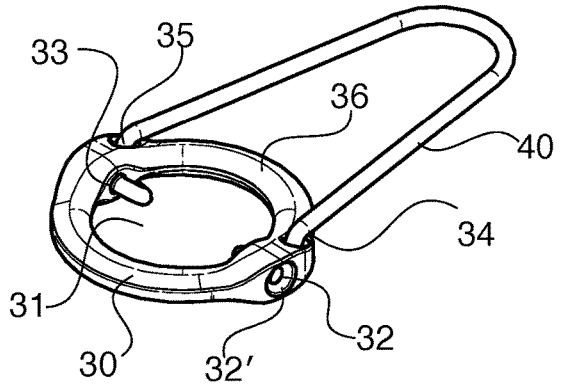
FIG. 16 shows a top perspective view of the second buckle portion according to one embodiment of the invention.
Figure 17:
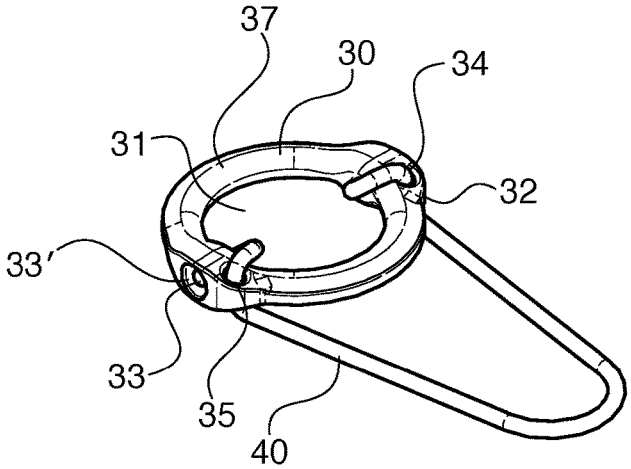
FIG. 17 shows a bottom perspective view of the second buckle portion.
Figure 18:
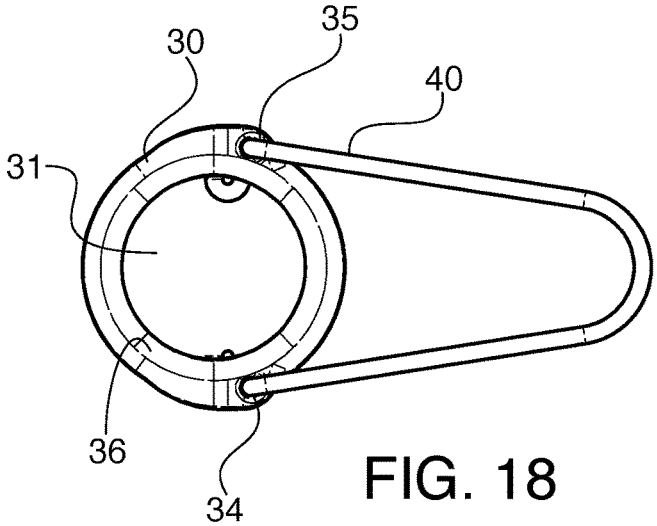
FIG. 18 shows a top plan view of the second buckle portion.
Figure 19:
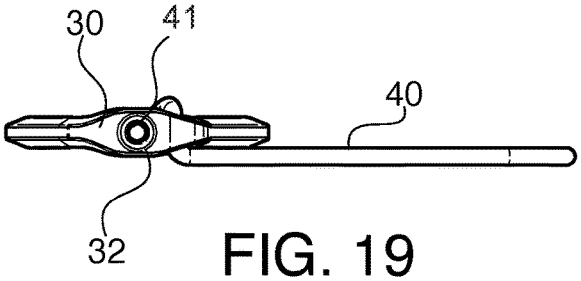
FIG. 19 shows a side view of the second buckle portion.
Figure 20:
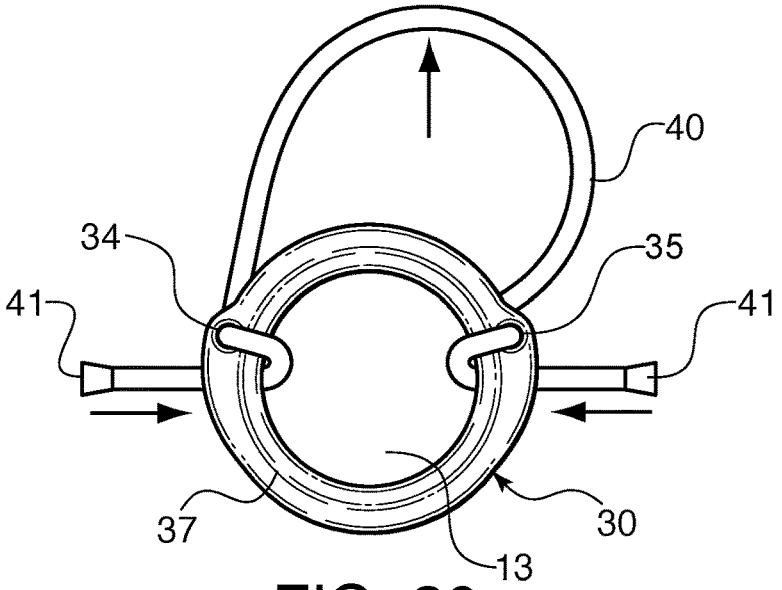
FIG. 20 illustrates the assembly of the cord onto the pull ring of the second buckle portion.

Pull ring 30 is shown in detail in FIGS. 16-20. Pull ring 30 has a central aperture 31, first and second bores 32, 33 which extend from the central aperture 31 radially outward to an outer face of the pull ring, and third and fourth bores 34, 35, which extend axially from a front face 36 to a rear face 37 of pull ring 30, adjacent first and second bores 32, 33. The outer surface of the pull ring 30 adjacent bores 32, 33 is flat. A pull cord 40 extends through from the exterior of pull ring 30 through first bore 32, around the central aperture 31 and, through third bore 34, across front face 36 through fourth bore 35 to rear face 37 and then through second bore 33 from inside to outside, as shown in FIGS. 16 and 17, to secure pull cord 40 to pull ring 30. Nodes 41 as shown in FIGS. 19 and 20 are attached to each of the free ends of pull cord 40 after pull cord 40 is threaded through bores 32-35 so that when pull cord 40 is pulled between bores 34 and 35, the free ends with nodes 41 are seated in first and second bores 32, 33 and cannot be pulled through. As shown in FIGS. 16 and 17, the exterior portions of bores 32, 33 have widenings 32', 33' to accommodate nodes 41 so that they do not protrude from bores 32, 33 during use. As shown in FIG. 20, nodes 41 can be conical or triangular in shape, widening toward the ends, and widenings 32', 33' can have a corresponding shape as well. One way to construct pull ring 30 is to thread pull cord 40 through bores 32-35 and then mold nodes 41 onto the free ends of pull cord 40 so that pull cord 40 is permanently attached to pull ring 30.

Figure 21:
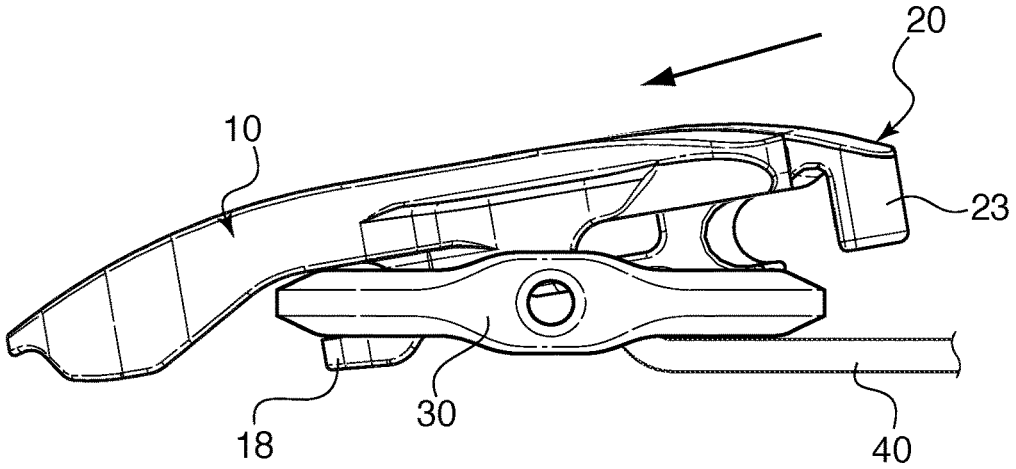
FIG. 21 illustrates the assembly and release of the second buckle portion with the first buckle portion.
Figure 22:
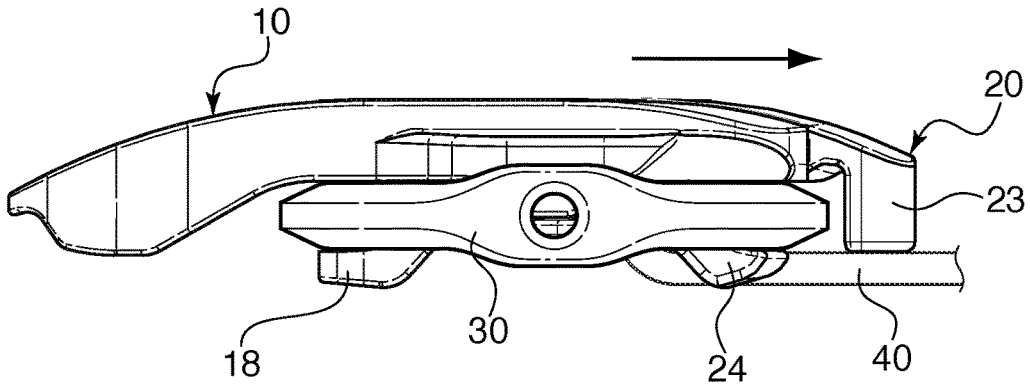
FIG. 22 shows a side view of the buckle assembly in a fully assembled state.

FIGS. 21 and 22 illustrate how pull ring 30 is mounted onto first buckle portion 10. First, pull ring 30 is hooked onto first hook element 18 of first buckle portion 10. Then, actuation button is slid toward first buckle portion 10 by pressing on push surface 23, causing spring 50 to compress (see FIG. 15). Actuation button 20 is pushed toward first buckle portion 10 until second hook element 24 clears pull ring 30, at which point first buckle portion 10 can be pushed down so that second hook element 24 catches the inside surface of pull ring 30 and secures pull ring 30 to first buckle portion 10. Releasing actuation button 20 allows spring 50 to return to its extended position as shown by the arrow in FIG. 22, and lock pull ring 30 to first buckle portion 10. The spring tension of spring 50 prevents pull ring 30 from becoming disengaged from first buckle portion 10.

To release first buckle portion 10, the user presses push surface 23 as shown in FIG. 21 until second hook element 24 clears pull ring 30, at which point first buckle portion 10 can be lifted off of that side of pull ring 30. Then, pull ring 30 can be removed from first hook element 18 to separate the two buckle portions from each other.

Figure 23:
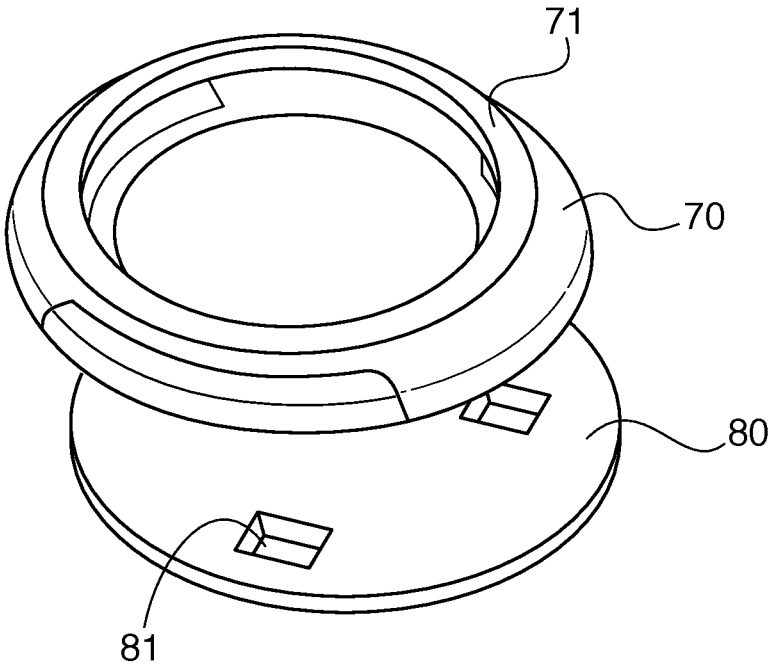
FIG. 23 shows an alternative embodiment of the second buckle portion.
Figure 24:
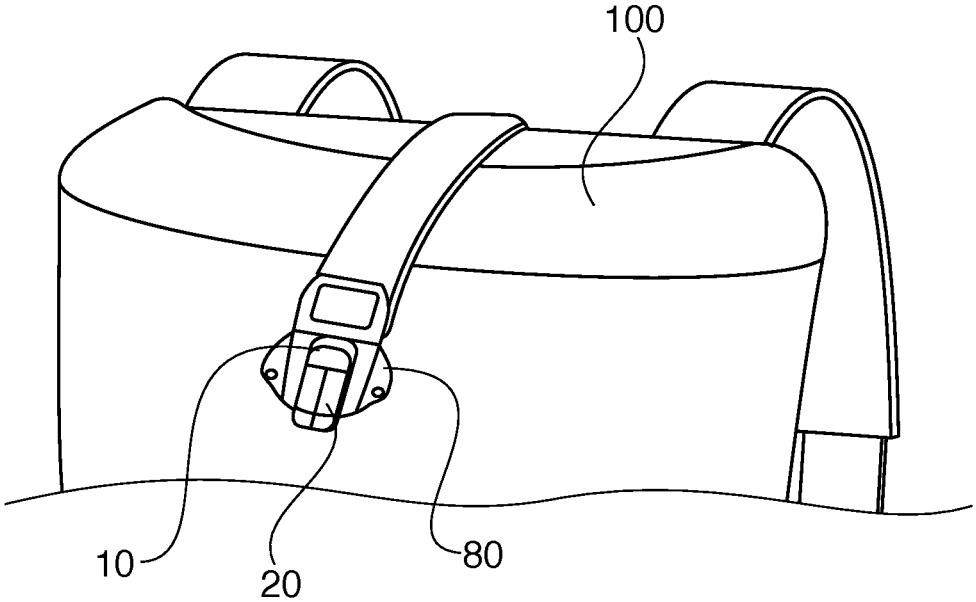
FIG. 24 shows the buckle assembly using the embodiment of FIG. 23 installed on an article.

Instead of the pull ring 30 with pull cord 40, a different mechanism can be attached to first buckle portion 10, as shown in FIGS. 23 and 24. In this embodiment, the second buckle portion is in the form of a ring 70, which has an overhanging lip 71, which engages with hook elements 18 and 24 on first buckle portion 10 and actuation button 20 to secure ring 70 to first buckle portion 10 in the same manner as described with respect to FIGS. 21 and 22. Ring 70 is configured to be connected to a plate 80 for attachment to an article such as a backpack 100. Plate 80 can be sewn on to backpack 100 and then ring 70 can be attached to plate 80 via hooks or catches which engage in apertures 81, or can be sewn on to backpack 100, in any suitable manner. This embodiment allows for a very simple and secure way to close the top of a backpack. The spring tension of spring 50 keeps the buckle in a locked position without requiring a lot of force to unlock or any bending of the plastic parts of the buckle.

Accordingly, while only a few embodiments of the present invention have been shown and described, it is obvious that many changes and modifications may be made thereunto without departing from the spirit and scope of the invention.

What is claimed is:

1. A pull ring comprising;

a ring body with a central aperture, a first face side and a second face side, a first bore extending radially from a radially outer surface of the ring body to the central aperture, a second bore extending radially from the radially outer face of the ring body to the central aperture on an opposite side of the ring body from the first bore, a third bore extending from the first face side of the ring body to the second face side of the ring body adjacent the first bore, and a fourth bore extending from the first face side of the ring body to the second face side of the ring body adjacent the second bore, and a pull cord that extends from outside the ring body through the first bore to the central aperture, around to the first face side, through the third bore to the second face side, into the fourth bore from the second face side to the first face side, around the ring body and through the second bore from the central aperture to the exterior of the ring body, wherein one end of the pull cord extends from the first bore and an opposite end of the pull cord extends from the second bore, and wherein each end of the pull cord has a node that is larger than a diameter of the first and second bores so that pulling the pull cord between the third bore and the fourth bore presses the nodes against the first bore and second bore without allowing the pull cord to pass through.

2. The pull ring according to claim 1, wherein the first bore and the second bore each have an enlarged region at the radially outer surface of the ring body, and wherein the nodes are seated in the enlarged regions when the pull cord is pulled between the third and fourth bores.

3. The pull ring according to claim 2, wherein the enlarged region tapers toward the central aperture, and wherein each node has a shape corresponding to the enlarged region, so that the nodes do not extend beyond the radially outer surface of the ring body when the cord is pulled between the third and fourth bores.

4. The pull ring according to claim 1, wherein the radially outer surface of the ring body is flat in an area of the first bore and in an area of the second bore.

* * * * *